US010808668B2

(12) United States Patent
Zhang et al.

(10) Patent No.: US 10,808,668 B2
(45) Date of Patent: Oct. 20, 2020

(54) METHODS AND SYSTEMS FOR A FUEL INJECTOR

(71) Applicant: Ford Global Technologies, LLC, Dearborn, MI (US)

(72) Inventors: Xiaogang Zhang, Novi, MI (US); Jianwen James Yi, West Bloomfield, MI (US); Mark Meinhart, Dexter, MI (US); Joseph F. Basmaji, Waterford, MI (US); Steven Wooldridge, Manchester, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 4 days.

(21) Appl. No.: 16/149,877

(22) Filed: Oct. 2, 2018

(65) Prior Publication Data

US 2020/0102923 A1 Apr. 2, 2020

(51) Int. Cl.
*F02M 61/18* (2006.01)

(52) U.S. Cl.
CPC ..... *F02M 61/184* (2013.01); *F02M 61/1813* (2013.01); *F02M 61/1826* (2013.01); *F02M 61/1833* (2013.01); *F02M 61/1806* (2013.01); *F02M 2200/06* (2013.01); *F02M 2700/07* (2013.01)

(58) Field of Classification Search
CPC ..... F02M 61/1833; F02M 61/184
See application file for complete search history.

(56) References Cited

U.S. PATENT DOCUMENTS 5,109,823 A * 5/1992 Yokoyama ..... F02M 51/0671 123/472
5,588,412 A * 12/1996 Nozaki ..... F02M 61/182 123/496
5,645,225 A * 7/1997 Hasegawa ..... F02M 61/18 239/533.12
5,947,389 A * 9/1999 Hasegawa ..... F02M 61/042 239/533.2
5,975,433 A * 11/1999 Hasegawa ..... F02M 45/08 239/533.12
5,979,802 A * 11/1999 Hasegawa ..... F02M 45/086 239/533.12
6,029,913 A 2/2000 Stroia et al.
6,047,904 A * 4/2000 Sugimoto ..... F02M 61/1833 239/533.12

(Continued)

FOREIGN PATENT DOCUMENTS

EP 2011993 A1 1/2009

OTHER PUBLICATIONS

Zhang, X. et al., "Methods and Systems for a Fuel Injector," U.S. Appl. No. 15/921,516, filed Mar. 14, 2018, 46 pages.

(Continued)

*Primary Examiner* — Kevin R Steckbauer
(74) *Attorney, Agent, or Firm* — Geoffrey Brumbaugh; McCoy Russell LLP

(57) ABSTRACT

Methods and systems are provided for an injector. In one example, the injector comprises at least two passages, wherein outlets of each of the passages are differently shaped than corresponding inlets of the passages. Further, in one or more examples, each of the outlets may be shaped and sized differently with respect to each other.

16 Claims, 10 Drawing Sheets

(56) References Cited

U.S. PATENT DOCUMENTS 6,055,957 A * 5/2000 Hasegawa ..... F02D 41/40 123/305
6,070,811 A * 6/2000 Takeda ..... F02M 61/1833 239/533.12
6,142,392 A * 11/2000 Takeda ..... F02M 61/1833 239/533.12
6,161,781 A * 12/2000 Kojima ..... F02M 61/1833 239/533.12
6,170,763 B1 * 1/2001 Fuchs ..... F02M 61/162 239/533.11
6,412,712 B1 * 7/2002 Buckley ..... F02M 61/10 239/533.12
6,543,133 B2 4/2003 D'Arrigo
6,625,971 B2 9/2003 Graves
6,695,229 B1 2/2004 Heinbuch et al.
6,776,358 B2 * 8/2004 Arimoto ..... F02M 61/042 239/533.3
6,826,833 B1 * 12/2004 Maier ..... B23P 15/16 239/463
7,793,859 B2 * 9/2010 Kolb ..... B01J 4/002 239/11
7,798,430 B2 * 9/2010 Kuronita ..... F02M 61/182 123/305
8,672,239 B2 * 3/2014 Ogura ..... F02M 61/1846 239/533.12
9,518,547 B2 12/2016 John
9,556,844 B2 1/2017 Rowan et al.
9,587,606 B2 3/2017 Anders et al.
9,677,526 B2 * 6/2017 Yasukawa ..... F02M 51/0671
9,850,869 B2 * 12/2017 Raney ..... F02M 61/1806
10,001,101 B2 * 6/2018 Sugiyama ..... F02M 61/184
10,024,288 B2 * 7/2018 Yasukawa ..... F02M 51/0675
10,047,714 B2 * 8/2018 Kobayashi ..... F02M 61/1806
10,208,653 B2 * 2/2019 Maier ..... F02B 19/18
10,208,722 B2 * 2/2019 Kato ..... F02M 51/06
10,344,727 B2 * 7/2019 Takahashi ..... F02M 61/1886
10,352,285 B2 * 7/2019 Noguchi ..... F02M 61/1853
10,408,180 B2 * 9/2019 Kato ..... F02M 61/10
2008/0073452 A1 * 3/2008 Kuronita ..... F02M 61/182 239/601
2010/0320293 A1 * 12/2010 Ogura ..... F02M 61/1846 239/533.12
2015/0021416 A1 * 1/2015 Raney ..... F02M 61/1846 239/558
2015/0047611 A1 * 2/2015 Yasukawa ..... F02M 61/1833 123/445
2015/0159612 A1 * 6/2015 Kato ..... F02B 23/104 123/295
2015/0204291 A1 * 7/2015 Schnobrich ..... F02M 61/1853 239/584
2015/0211458 A1 * 7/2015 Carpenter ..... F02M 57/04 123/445
2015/0211462 A1 * 7/2015 Schnobrich ..... F02M 61/1826 239/589
2015/0219051 A1 * 8/2015 Carpenter ..... F02M 61/18 239/584
2015/0285201 A1 * 10/2015 Serizawa ..... F02M 61/1846 239/584
2016/0047346 A1 * 2/2016 Sugiyama ..... F02M 61/1846 239/584
2016/0097361 A1 * 4/2016 Noguchi ..... F02M 61/1826 239/288.5
2016/0108877 A1 * 4/2016 Hashimoto ..... F02M 61/1813 239/562
2017/0082077 A1 * 3/2017 Kato ..... F02M 61/1813
2017/0167359 A1 * 6/2017 Maier ..... F02B 19/18
2017/0241391 A1 * 8/2017 Yasukawa ..... F02M 61/1813
2018/0058405 A1 * 3/2018 Zhang ..... B05B 1/1663
2018/0142657 A1 * 5/2018 Kobayashi ..... F02M 61/1806
2018/0202405 A1 * 7/2018 Kato ..... F02M 61/1813
2018/0363615 A1 * 12/2018 Yasukawa ..... F02M 67/12
2019/0003438 A1 * 1/2019 Ginter ..... F02M 61/184
2019/0093617 A1 * 3/2019 Niwa ..... F02M 51/06
2019/0345907 A1 * 11/2019 Kato ..... F02M 61/10
2020/0032756 A1 * 1/2020 Hong ..... F02M 45/086

OTHER PUBLICATIONS

Hong, S. et al., "Multi-Hole Fuel Injector With Twisted Nozzle Holes," U.S. Appl. No. 16/047,946, filed Jul. 27, 2018, 37 pages.

* cited by examiner

590

METHODS AND SYSTEMS FOR A FUEL INJECTOR

FIELD

The present description relates generally to a fuel injector comprising differently shaped fuel nozzle passages.

BACKGROUND/SUMMARY

In engines, air is drawn into a combustion chamber during an intake stroke by opening one or more intake valves. Then, during the subsequent compression stroke, the intake valves are closed, and a reciprocating piston of the combustion chamber compresses the gases admitted during the intake stroke, increasing the temperature of the gases in the combustion chamber. Fuel is then injected into the hot, compressed gas mixture in the combustion chamber. The mixture may be ignited via a spark or upon reaching a threshold pressure. The combusting air-fuel mixture pushes on the piston, driving motion of the piston, which is then converted into rotational energy of a crankshaft.

However, the inventors have recognized potential issues with such engines. As one example, fuel may not mix evenly with the air in the combustion chamber, leading to the formation of dense fuel pockets in the combustion chamber. These dense regions of fuel may produce soot as the fuel combusts. As such, engines may include particulate filters for decreasing an amount of soot and other particulate matter in their emissions. However, such particulate filters lead to increased manufacturing costs and increased fuel consumption during active regeneration of the filter.

Modern technologies for combating engine soot output and poor air/fuel mixing may include features for entraining air with the fuel prior to injection. This may include passages arranged in an injector body, as an insert into the engine head deck surface, or integrated in an engine head. Ambient air mixes with the fuel, cooling the injection temperature, prior to delivering the mixture to the compressed air in the cylinder. By entraining cooled air with the fuel prior to injection, a lift-off length is lengthened and start of combustion is retarded. This limits soot production through a range of engine operating conditions, reducing the need for a particulate filter.

However, the inventors herein have recognized potential issues with such injectors. As one example, the previously described fuel injectors may no longer sufficiently prevent soot production to a desired level in light of increasingly stringent emissions standards. Additionally, the previously described fuel injectors may only limit soot production in diesel engines, where air/fuel have a longer duration of time to mix before combustion than in spark-ignited engines.

In one example, the issues described above may be addressed by an injector comprising a first injector nozzle passage twisting from a first inlet to a first outlet, the first inlet shaped differently than the first outlet and a second injector nozzle passage twisting from a second inlet to a second outlet, the second inlet shaped differently than the second outlet. In this way, penetration may be more controlled to increase fuel/air mixing for more optimal combustion.

As one example, the outlet shape may comprise a small angle in a direction away from the piston, which may reduce piston wetting. Fuel penetration along an injection spray direction may be mitigated due to the fuel twisting in the fuel nozzle passage as the fuel nozzle passage transitions from the inlet shape to the outlet shape. The fuel twisting may divide a fuel velocity into a plurality of directions, thereby decreasing fuel penetration in a general direction of fuel injection while increasing turbulence, which may promote increased mixing between the fuel and combustion chamber gases.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-8D are shown approximately to scale, although other relative dimensions may be used, if desired.

DETAILED DESCRIPTION

Figure 2:
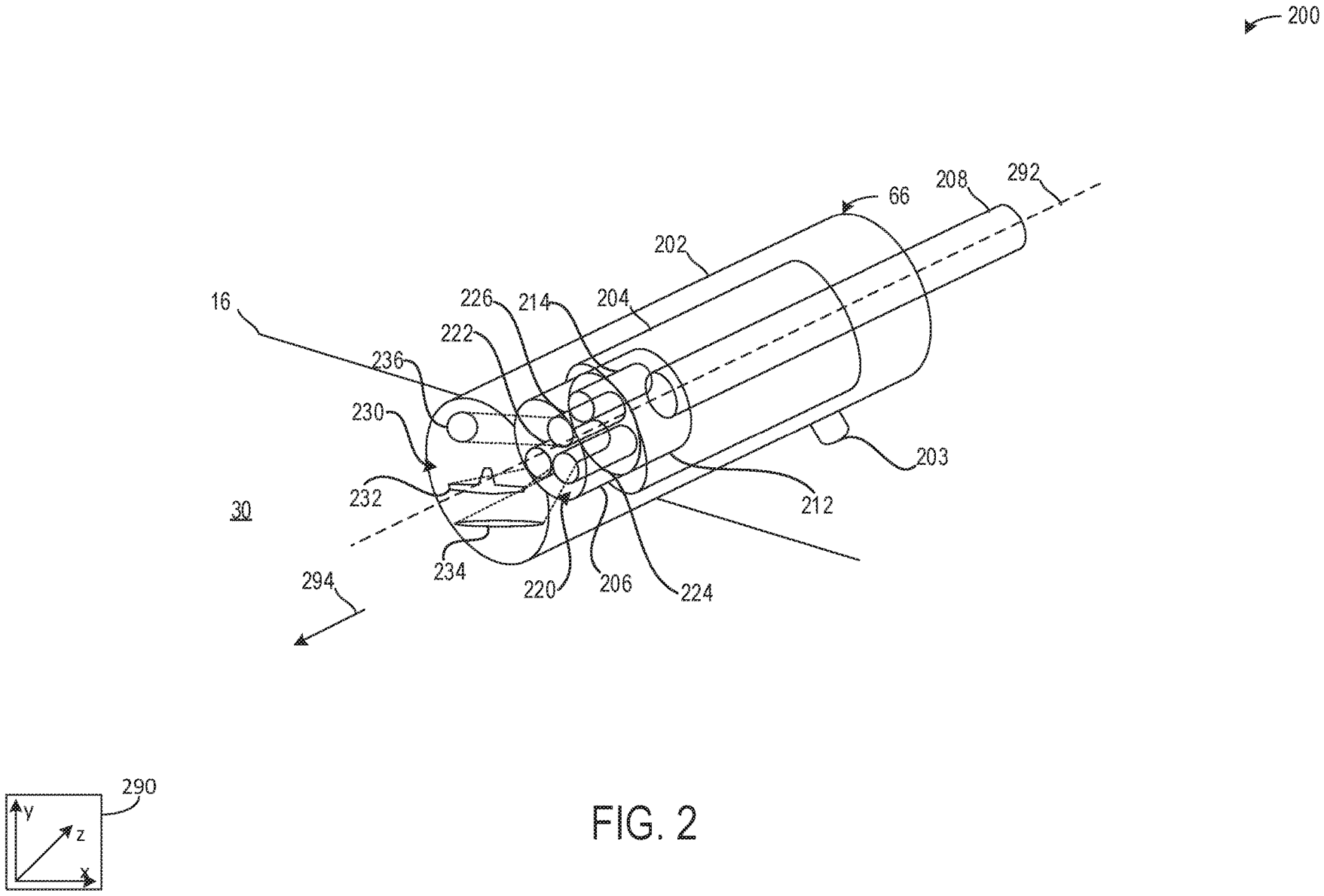
FIG. 2 illustrates an embodiment of a fuel injector comprising a plurality of fuel injector nozzle passages.
Figure 3:
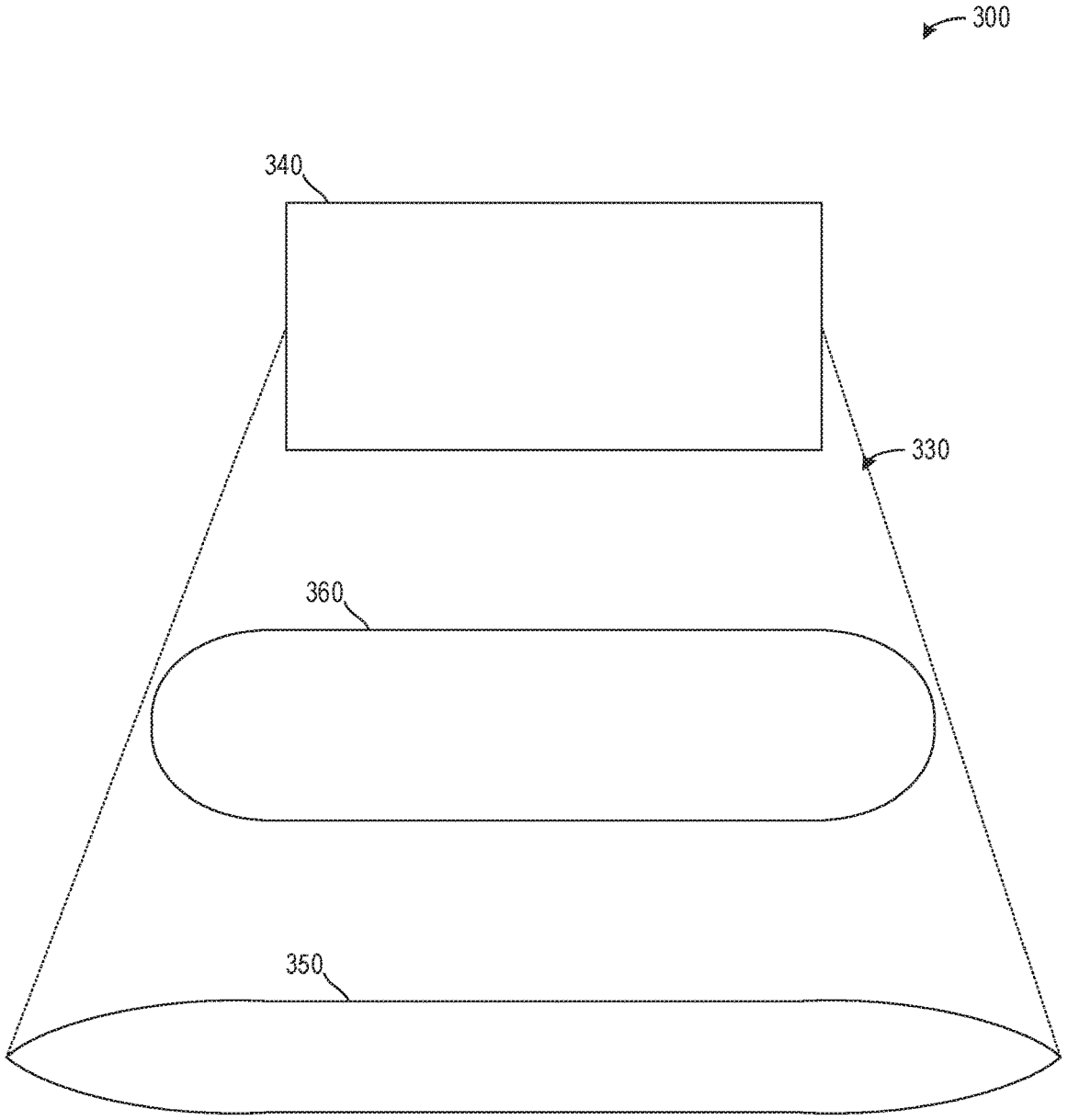
FIG. 3 illustrates a first embodiment of a fuel injector nozzle passage.
Figure 4:
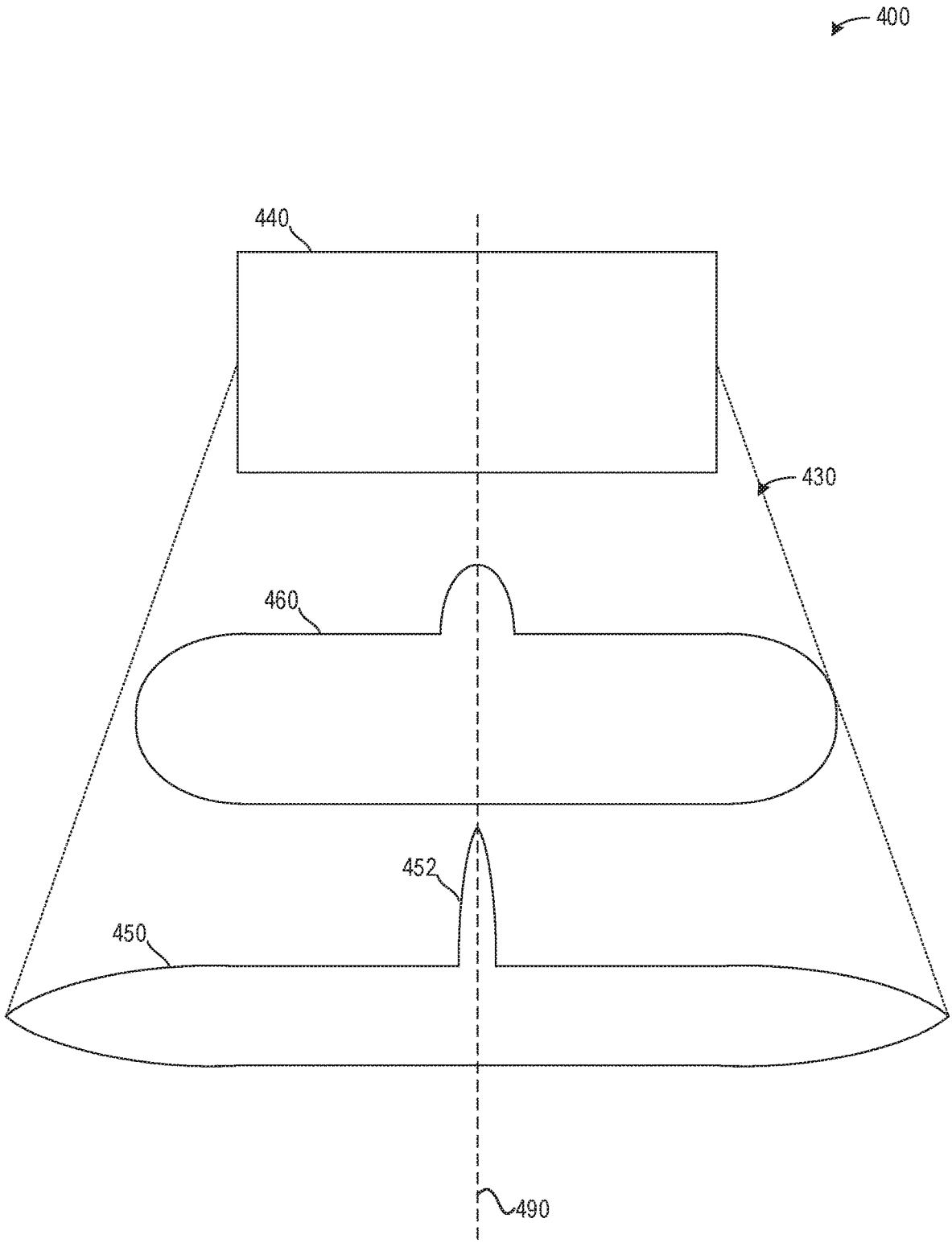
FIG. 4 illustrates a second embodiment of a fuel injector nozzle passage.
Figure 5B:
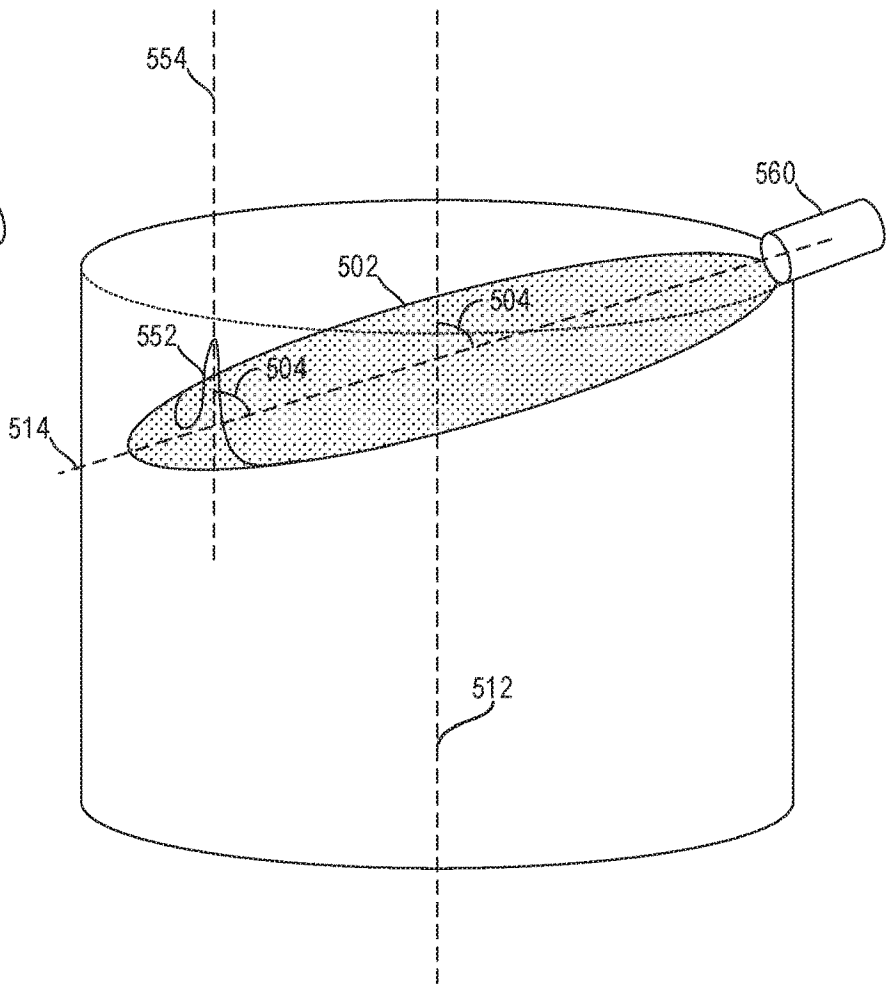
FIGS. 5B and 5C illustrate a fuel spray pattern of the second embodiment of the fuel injector nozzle passage.
Figure 5A:
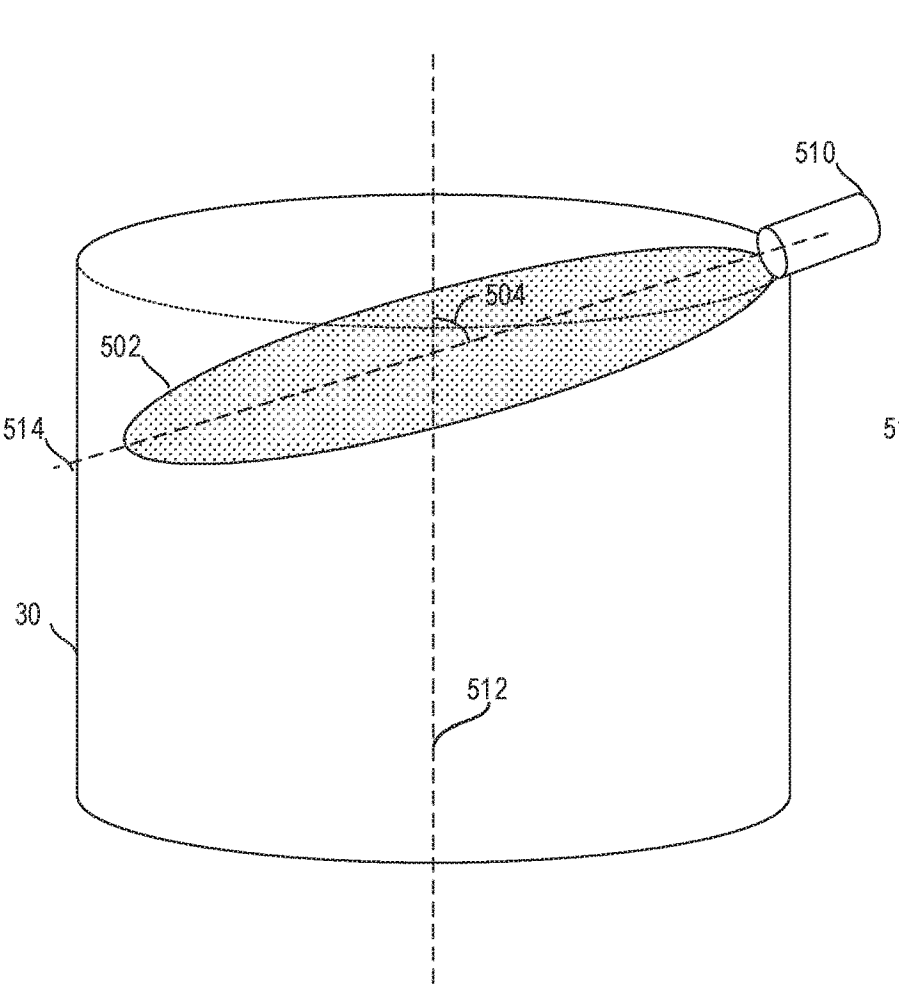
FIG. 5A illustrates a fuel spray pattern of the first embodiment of the fuel injector nozzle passage.
Figure 5C:
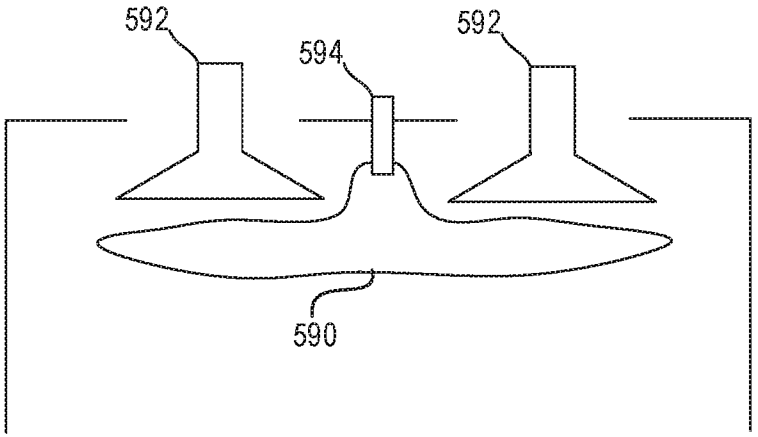
Figure 6B:
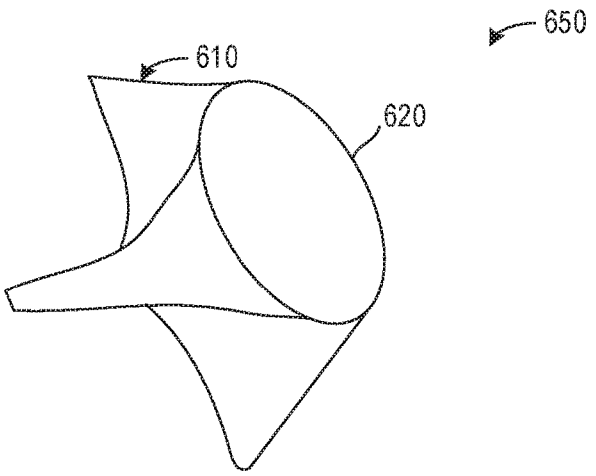
FIGS. 6A and 6B illustrate a third embodiment of a fuel injector nozzle passage.
Figure 6A:
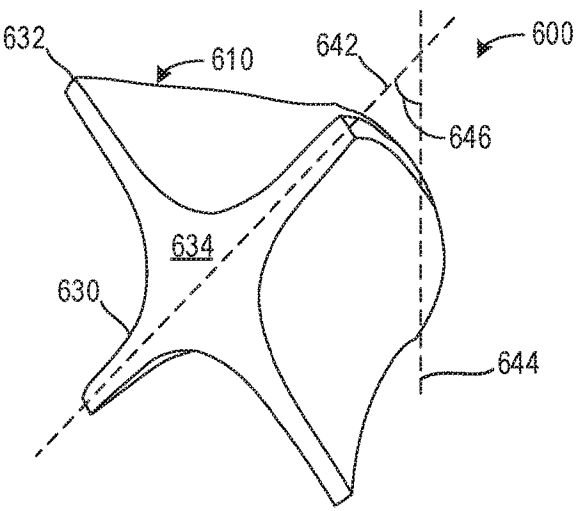
Figure 6C:
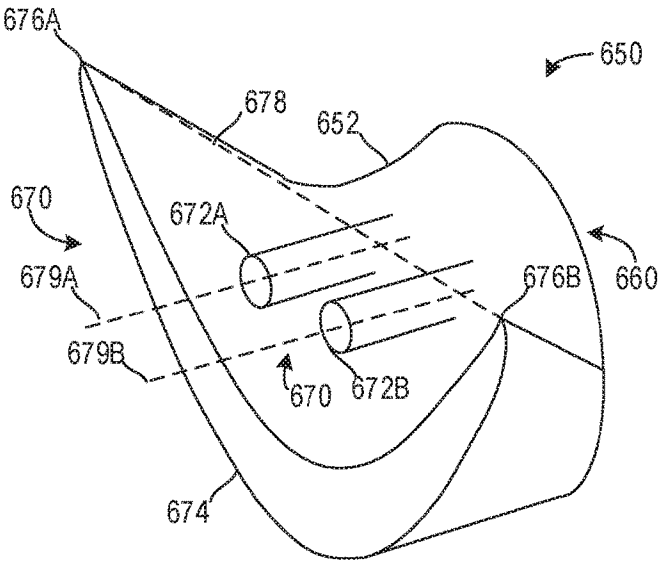
FIG. 6C illustrates a fourth embodiment of a fuel injector nozzle passage.
Figure 7B:
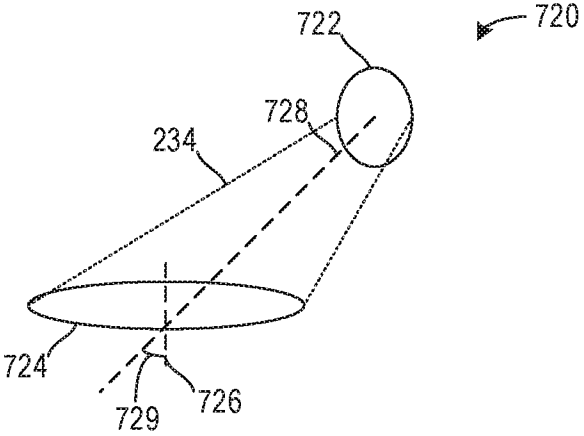
FIGS. 7A, 7B, and 7C illustrate example orientations of the fuel injector nozzle passages of the fuel injector.
Figure 7A:
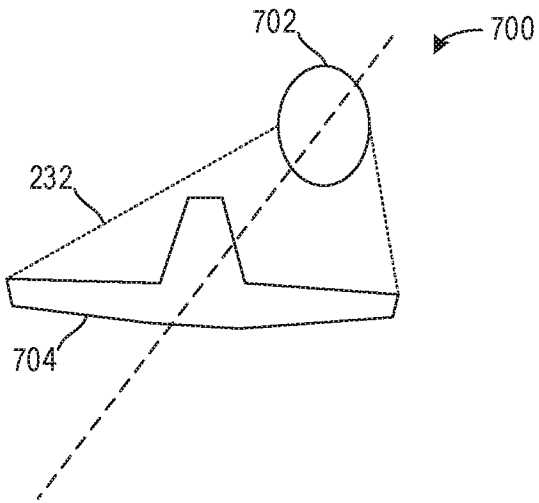
Figure 7C:
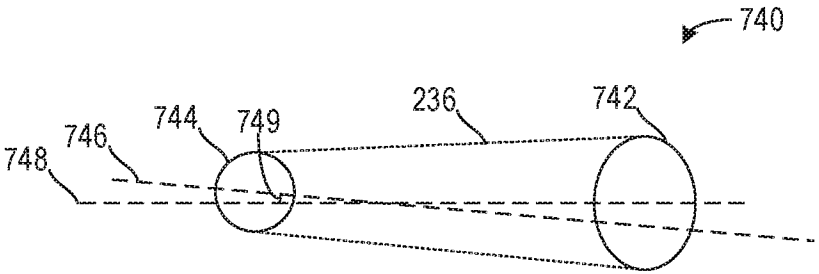
Figure 8B:
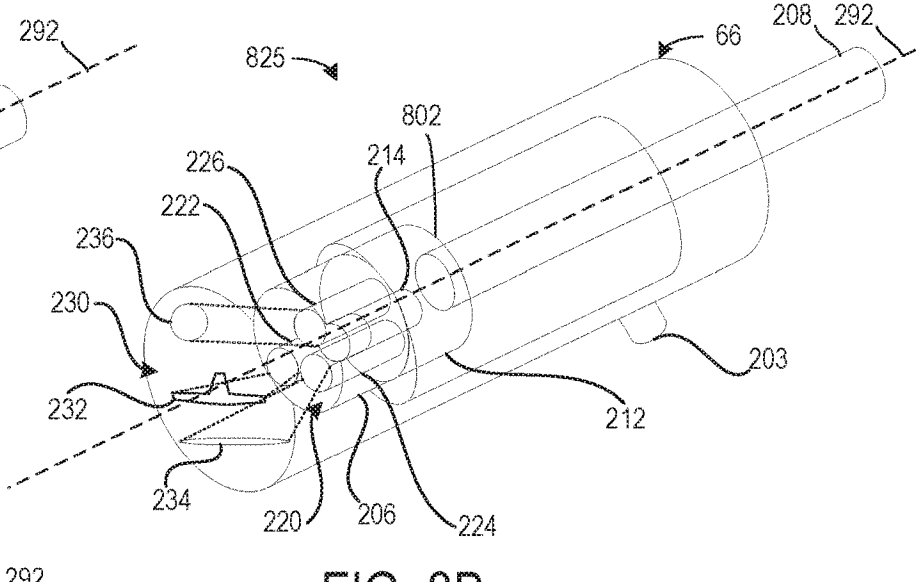
FIGS. 8A, 8B, 8C, and 8D illustrate various positions of a fuel injector comprising a plurality of fuel injector nozzle passages.

The following description relates to systems and methods for a fuel injector. The fuel injector may be positioned to inject into a combustion chamber of an engine, such as the engine illustrated in FIG. 1. The fuel injector may comprise a plurality of nozzle passages comprising differently shaped inlets and outlets, as shown in FIG. 2. The inlet may comprise a first shape and the outlet may comprise a second shape different than the first shape. A first embodiment of a nozzle passage is shown in FIG. 3, wherein the inlet may comprise a rectangular shape and the outlet may comprise an oblong shape. A second embodiment of a nozzle passage is shown in FIG. 4, wherein the inlet may comprise a rectangular shape and the outlet may comprise a sombrero shape. An injection pattern of the first embodiment of the nozzle passage is shown in FIG. 5A. An injection pattern of the second embodiment of the nozzle passage is shown in FIGS. 5B and 5C. A third embodiment of a nozzle passage is shown in FIGS. 6A and 6B, wherein the third embodiment comprises a twisted plus-shape. A fourth embodiment of a nozzle passage is shown in FIG. 6C, wherein the fourth embodiment comprises a smiley face shape. The different nozzle passages of the fuel injector may comprise differently shaped outlets. The different nozzle passages may also be oriented differently relative to a central axis of the fuel injector, as shown in FIGS. 7A, 7B, and 7C. The fuel injector may comprise an injector pin, which may be rotated to select one or none of the nozzle passages to inject fuel through. The injector pin may be rotated to different quadrants of the fuel injector as shown in FIGS. 8A, 8B, 8C, and 8D. A method for rotating the injector pin based on a piston position is shown in FIG. 9.

FIGS. 1-8D show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Figure 1:
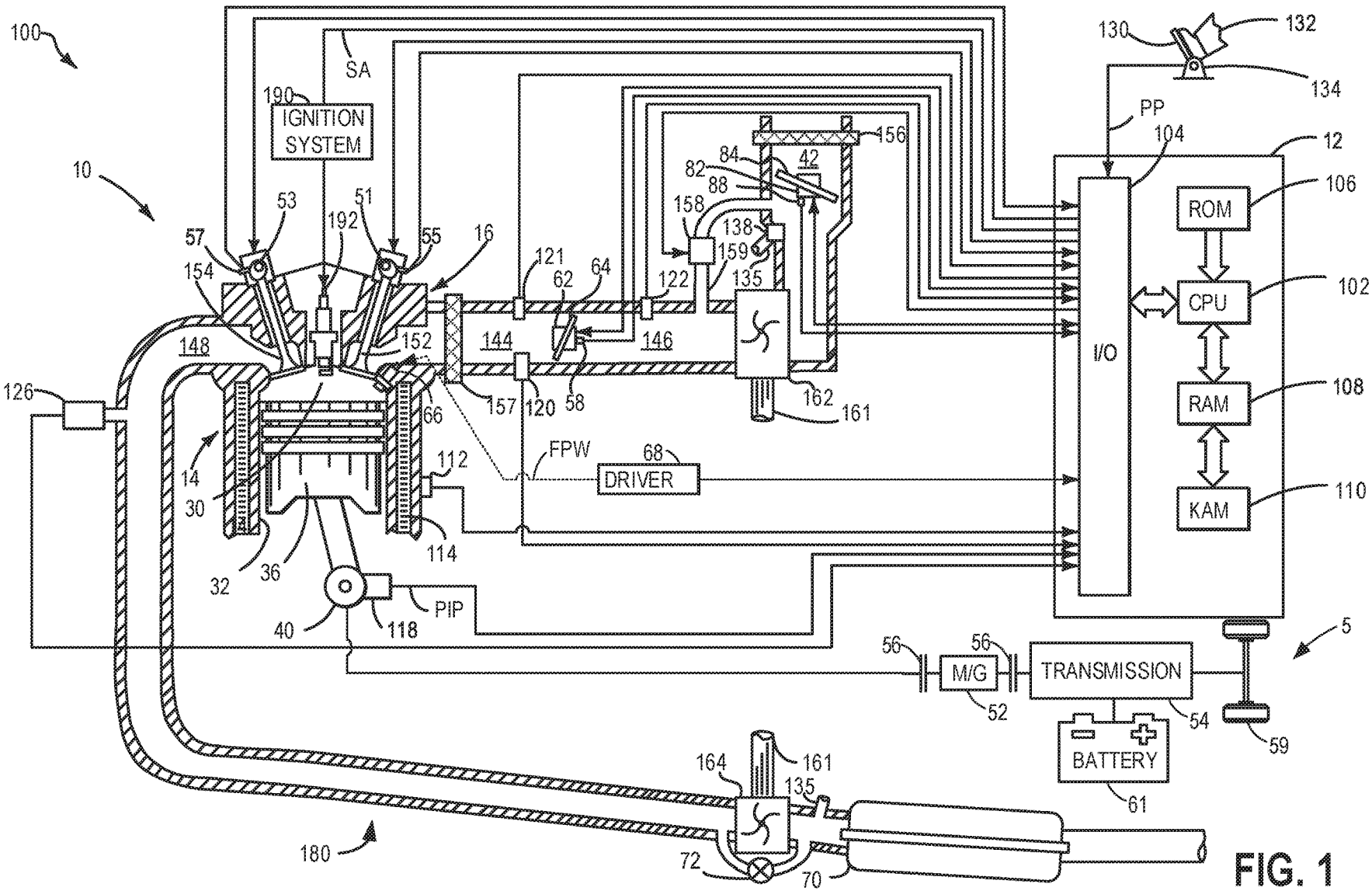
FIG. 1 illustrates a schematic of an engine included in a hybrid vehicle.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36 between top-dead center (TDC) and bottom-dead center (BDC). Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber and cylinder bore 20 may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

The injector 66 may be shaped to flow a mixture of liquids and/or gases through one or more of its passages to be injected into the combustion chamber 30. The mixture may include one or more of alcohol, different octane rated fuels, diesel, cleaners, catalysts, and the like.

The injector 66 may comprise a plurality of nozzle passages fluidly coupling the injector to the combustion chamber 30. The plurality of nozzle passages may be differently shaped such that an injection pattern of each nozzle passage may be different. In one example, the plurality of nozzle passages may be shaped to inject at different piston positions opportunistically wherein a mixing rate is increased and/or emissions are decreased. The injector 66 and the nozzle passages thereof are described in greater detail below.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 59. Electric machine 52 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, adjusting operation of the fuel injector 66 may include signaling to an actuator of the injector to inject more or less fuel.

Turning now to FIG. 2, it shows an embodiment 200 of the fuel injector 66 arranged in the cylinder head 16 and positioned to inject into the combustion chamber 30. As such, components previously introduced may be similarly numbered in this figure and in subsequent figures. An axis system 290 is shown comprising three axes, namely an x-axis parallel to a horizontal direction, a y-axis parallel to a vertical direction, and a z-axis perpendicular to each of the x- and y-axes. Dashed line 292 may illustrate a central axis of the fuel injector 66. Herein, dashed line 292 may be referred to as central axis 292. The central axis 292 may be substantially parallel to a general direction of injection, shown by arrow 294. Herein, arrow 294 may be referred to as the general direction of injection 294. An orientation of the fuel injector 66 illustrated in the example of FIG. 2 is shown angled to the y-axis. In one example, the fuel injector 66 may be positioned to inject at an angle relative to an axis of oscillation of a piston of the combustion chamber, wherein the axis of oscillation may be parallel to the y-axis. Additionally or alternatively, the fuel injector 66 may be oriented to inject parallel to the axis of oscillation without departing from the scope of the present disclosure.

The fuel injector 66 may comprise a fuel injector body 202 comprising a cylindrical shape. The fuel injector body 202 may be physically coupled to a portion of the cylinder head 16 via one or more of a boss, a fusion, an adhesive, a fastener, and a weld. The fuel injector body 202 may fully or at least partially house one or more components including an upper injector volume 204, an injector needle 208, an injector cylindrical pin 212, an injector upper tube 214, a plurality of injector lower tubes 220, and a plurality of injector nozzle passages 230.

The upper injector volume 204 may comprise a cylindrical shape similar to the fuel injector body 202. The upper injector volume 204 may comprise a diameter smaller than a diameter of the fuel injector body 202. The upper injector volume 204 may be completely housed within walls of the fuel injector body 202. The upper injector volume 204 may be arranged within the fuel injector body 202 such that it is spaced away from the walls of the fuel injector body 202.

The upper injector volume 204 may be shaped to receive fuel from a fuel passage 203 of a fuel system. The fuel passage 203 may be shaped to flow fuel into only the upper injector volume 204, wherein the fuel passage 203 may at least partially fill a volume of the upper injector volume 204.

Each of the injector cylindrical pin 212 and the injector upper tube 214 may be shaped to fit completely within the upper injector volume 204, and where surfaces of the injector cylindrical pin are spaced away from surfaces of the upper injector volume 204. By spacing the surfaces of the injector cylindrical pin 212 and the upper injector volume 204 away from each other, the injector cylindrical pin 212 may rotate more smoothly within the upper injector volume during various stages of a fuel injection. Rotation of the injector cylindrical pin 212 may occur in response to a signal from a controller (e.g., controller 12 of FIG. 1) to an actuator, which may result in actuation of the injector needle 208. The injector needle 208 may be coupled to the injector cylindrical pin 212 at its extreme end 802, where actuation of the injector needle 208 may result in actuation of the injector cylindrical pin 212. In one example, the actuation is a rotation. Additionally, or alternatively, actuation of the injector cylindrical pin 212 may further include actuation of the injector upper tube 214.

The injector upper tube 214 may be a hollow tube which may be filled with fuel from the upper injector volume 204 through all rotational positions of the injector cylindrical pin 212. The injector upper tube 214 may be rotated based on a rotation of the injector cylindrical pin 212, wherein the injector upper tube 214 may be aligned or misaligned with one or more of the plurality of injector lower tubes 220. More specifically, the injector cylindrical pin 212 may comprise an off position, which may correspond to the position illustrated in FIG. 2, a first injection position, a second injection position, and a third injection position. Each of the injection positions is illustrated and described in greater detail with respect to FIGS. 8A, 8B, 8C, and 8D.

The plurality of injector lower tubes 220 may comprise a first lower tube 222, a second lower tube 224, and a third lower tube 226. Each of the first lower tube 222, the second lower tube 224, and the third lower tube 226 may comprise a corresponding fuel injector nozzle passage of the plurality of injector nozzle passages 230. More specifically, the first lower tube 222 may be fluidly coupled to a first injector nozzle passage 232 of the plurality of injector nozzle passages 230, wherein the first injector nozzle passage 232 may be shaped to flow fuel from only the first lower tube 222 to the combustion chamber 30. The second lower tube 224 may be fluidly coupled to a second injector nozzle passage 234 of the plurality of injector nozzle passages 230, wherein the second injector nozzle passage 234 may be shaped to flow fuel from only the second lower tube 224 to the combustion chamber 30. The third lower tube 226 may be fluidly coupled to a third injector nozzle passage 236 of the plurality of injector nozzle passage 230, wherein the third injector nozzle passage 236 may be shaped to flow fuel from only the third lower tube 226 to the combustion chamber 30.

The injector cylindrical pin 212 may be rotated to align and misalign the upper tube 214 with the first, second, and third lower tubes 222, 224, and 226. The upper tube 214 may be identically shaped to each of the first, second, and third lower tubes 222, 224, and 226. As shown, the first, second, and third lower tubes may be arranged in different quadrants of a fixed pre-nozzle tube 206. The pre-nozzle tube 206 may be in face-sharing contact with the injector cylindrical pin 212. However, the pre-nozzle tube 206 may remain stationary despite a rotation of the injector cylindrical pin 212, thereby allowing the injector cylindrical pin 212 to be rotated to different positions to adjust a fuel injection.

Each of the first 232, second 234, and third 236 injector nozzle passages may comprise an inlet and an outlet, wherein the inlet is shaped to receive fuel from a corresponding injector lower tube, and where the outlet is shaped to inject fuel into the combustion chamber 30. The plurality of injector nozzle passages 230 may be further shaped to redirect a flow direction of the fuel such that the inlet may be at least partially misaligned with the outlet relative to the general direction of injection 294 and/or the central axis 292. As will be described herein, the inlets and the outlets of the plurality of injector nozzle passages 230 may comprise a variety of shapes, wherein the inlets and the outlets may vary between the plurality of injector nozzle passages 230. Additionally or alternatively, the inlet and the outlet of a single injector nozzle passage of the plurality of the injector nozzle passages 230 may be differently shaped, which may impart a swirl or turbulence onto a fuel flow flowing therethrough.

Turning now to FIG. 3, it shows a first embodiment 300 of an injector nozzle passage 330, which may be used similarly to one of the plurality of injector nozzle passages 230 of FIG. 2. The injector nozzle passage 330 comprises an inlet 340 and an outlet 350. The example of FIG. 3 further illustrates a cross-section of the injector nozzle passage 330 taken along a midpoint 360 of the injector nozzle passage 330, wherein the midpoint 360 may represent a midway transition between the inlet 340 and the outlet 350.

The injector nozzle passage 330 may be a hollow passage shaped to flow fuel from a portion of the fuel injector 66 of FIGS. 1 and 2. Thus, the inlet 340 and the outlet 350 may represent opposite extreme ends of the injector nozzle passage 330, wherein the inlet 340 may be shaped to receive and provide fuel to the injector nozzle passage 330. The outlet 350 may be shaped to expel fuel from the injector nozzle passage 330 to the combustion chamber 30.

The inlet 340 may comprise a first shape and the outlet 350 may comprise a second shape, different than the first shape. In the example of FIG. 3, the inlet 340 comprises a rectangular shape and the outlet 350 comprises a boat and/or pointed oval and/or marquise shape. Said another way, the outlet 350 may be oblong while comprising two pointed extreme ends. However, in the example of FIG. 3, the outlet 350 may deviate from the above described shapes in that at least a portion of the sides of the outlet 350 may be linear. However, it will be appreciated that the sides of the outlet may be curved to more closely mimic a football and/or marquise shape. Additionally or alternatively, the first shape of the inlet 340 may be a shape different than a rectangle, for example, the first shape may be a circle, square, triangle, diamond, pentagon, hexagon, polygon, or the like, without departing from the scope of the present disclosure.

The injector nozzle passage 330 may gradually transition in shape from the inlet 340 to the outlet 350. The midpoint 360 may be shaped equally similar to each of the inlet 340 and the outlet 350. That is to say, the midpoint 360 may represent an equal mixture of the inlet 340 and the outlet 350. Portions of the injector nozzle passage 330 between the inlet 340 and the midpoint 360 may more closely resemble the inlet 340 in shape, while portions of the injector nozzle passage 330 between the midpoint 360 and the outlet 350 may more closely resemble the outlet 350 in shape. Thus, a cross-section taken along a direction of fuel injection flow may be substantially circular and/or rectangular.

Turning now to FIG. 4, it shows a second embodiment 400 of an injector nozzle passage 430. The injector nozzle passage 430 may be used similarly to one of the plurality of injector nozzle passages 230 of FIG. 2. In one example of the fuel injector 66 of FIGS. 1 and 2, each of the injector nozzle passage 430 and the injector nozzle passage 330 of FIG. 3 may be arranged on the fuel injector 66. In this way, each injector nozzle passage of the plurality of injector nozzle passages 230 may be shaped differently to provide a different injection flow pattern, as will be described in greater detail below.

The injector nozzle passage 430 may be substantially similar to the injector nozzle passage 330 of FIG. 3, except that one or more of an inlet 440 and an outlet 450 of injector nozzle passage 430 may be shaped differently than the inlet 340 and the outlet 350 of the injector nozzle passage 330 of FIG. 3. The inlet 440 may comprise a first shape and the outlet 450 may comprise a second shape different than the first shape. In one example, the inlet 440 is shaped identically to the inlet 340 of FIG. 3. The outlet 450 may deviate from the outlet 350 in that the outlet 450 comprises a shape similar to an outline of a sombrero, wherein the sombrero outline may comprise a lower oblong portion (e.g., a rim of the sombrero) and an upper curved triangular portion extending from the lower oblong portion. That is to say, the outlet 450 may be shaped similarly to a boat and/or marquise, except that the outlet 450 comprises a protrusion 452 extending from only one side. In one example, the protrusion 452 is arranged such that the outlet 450 is symmetric and a central axis 490. Additionally or alternatively, the protrusion 452 may be arranged offset to the central axis 490 such that the outlet 450 is asymmetric.

The midpoint 460 may be equally similar to each of the inlet 440 and the outlet 450. Thus, the injector nozzle passage 430 may evenly transition from the inlet 440 to the outlet 405. It will be appreciated by those of ordinary skill in the art that the injector nozzle passage 430 may unevenly transition from the inlet 440 to the outlet 450 in some examples to provide alternative inject patterns and/or injection penetrations.

By arranging the differently shaped injector nozzle passages on a single fuel injector, the fuel injector may be shaped to achieve a plurality of desired injection patterns, wherein different injection patterns may be desired in response to different injection conditions (e.g., a piston location).

Turning now to FIGS. 5A and 5B, they show a first injection pattern 500 and a second injection pattern 550, respectively. The first injection pattern 500 may represent an injection pattern of the injector nozzle passage 330. The second injection pattern 550 may represent an injection pattern injector nozzle passage 430.

Turning now to FIG. 5A, the first injection pattern 500 comprising a substantially planar portion 502. The planar portion 502 may comprise a circular shape. An orientation of the planar portion 502 may be dependent on a position of the fuel injector 510. In one example, the fuel injector 510 may be positioned in a cylinder head surface adjacent one or more intake valves of the combustion chamber 30. The fuel injector 510 may be positioned such that fuel injector central axis 514 is parallel to a central axis 512 of the combustion chamber 30. Additionally or alternatively, the fuel injector 510 may be positioned such that its central axis 514 is angled to the central axis 512. In the example of FIG. 5A, the fuel injector 510 is positioned such that an angle 504 is generated between the fuel injector central axis 514 and the central axis 512, wherein the angle 504 may also correspond to an angle of the planar portion 502. The angle 504 may be between 5 and 60 degrees. In some examples, additionally or alternatively, the angle 504 may be between 10 and 50 degrees. In some examples, additionally or alternatively, the angle 504 may be between 15 and 40 degrees. In one example, the angle 504 is equal to 30 degrees.

Turning now to FIG. 5B, the second injection pattern 550 may be substantially similar to the first injection pattern 500 in that both injection patterns comprise the planar portion 502. However, the second injection pattern 550 further comprises a non-planar portion 552, which may result from the protrusion 452 of the outlet 450 of the injector nozzle passage 430 of FIG. 1. As such, the second injection pattern 550 may be shaped similarly to the outlet 450. An injector 560 may be positioned similarly to the injector 510 of FIG. 5A such than the planar portion 502 is angled at the angle 504 relative to the central axis 512. While a flow path of the non-planar portion 552 may be parallel to the planar portion 502, an axis 554 of the non-planar portion 552 may be angled to the planar portion 502 equal to the angle 504 while being parallel to the central axis 512.

Turning now to FIG. 5C, it shows an additional view 590 of the injection pattern 550, wherein the injection pattern 550 is illustrated relative to one or more intake valves 592 and a spark plug 594. In one example, the one or more intake valves 592 may be used similarly to intake valves 152 of FIG. 1. Furthermore, spark plug 594 may be used similarly to spark plug 192 of FIG. 1.

The injection pattern 550 may be shaped such that a lower portion of the injection pattern 550, which may correspond to the planar portion 502 of FIG. 5B, may extend below an open position of the intake valves 592. As such, the portion of the fuel injection included in the planar portion 502 may avoid the intake valves 592 such that fuel may not impinge onto the intake valves 592.

The injection pattern 550 may be further shaped via the non-planar portion 552 to inject with a threshold proximity of the spark plug 594. The threshold proximity may be within a threshold distance of the spark plug 594 or may overlap the spark plug 594. In one example, an upper portion of the non-planar portion 552 of the injection pattern 550 overlaps the spark plug 594. Additionally or alternatively, the injection pattern 550 may be shaped to flow between the intake valves 592. In this way, the injection pattern 550 may comprise an inverted T-shape.

Turning now to FIGS. 6A and 6B, they show a face-on perspective view 600 and a rear-side perspective view 650 of a fuel injection nozzle passage 610, respectively. The fuel injection nozzle passage 610 may comprise an inlet 620 and an outlet 630. The inlet 620 may comprise a first shape and the outlet 630 may comprise a second shape, different than the first shape of the inlet 620. The inlet 620 may be substantially circular, however, the inlet 620 may be other shapes including one or more of triangular, square, rectangular, pentagonal, or the like, without departing from a scope of the present disclosure.

The outlet 630 may be plus shaped and/or cross shaped. As such, the outlet 630 may comprise a plurality of arms 632 extending from a central region 634. The central region may comprise a diameter smaller than a diameter of the inlet 620. The plurality of arms 632 may extend from an outer circumference of the central region 634 to a location outside a profile of the inlet 620. That is to say, a combined total of the central region 634 radius and a length of an arm of the plurality of arms 632 may be greater than a radius of the inlet 620. In this way, the outlet 630 may be less compact than the inlet 620, while comprising a substantially similar cross-sectional flow-through area to the inlet 620.

A profile of the plurality of arms 632 may be twisted and/or angled relative to an origination point arranged on the inlet 620. Said another way, each arm of the plurality of arms 632 may comprise an initial point and/or an origination point from where a body of the arm may extend. The body may twist as it extends toward an end point, wherein the end point may represent an area of the outlet 630 where fuel is expelled. An outlet arm axis 642 may be angled via angle 646 relative to inlet arm origination point axis 644. The angle 646 may be equal to an angle between 5 and 90 degrees. In some examples, additionally or alternatively, the angle 646 may be equal to an angle between 15 and 70 degrees. In some examples additionally or alternatively, the angle 646 may be equal to an angle between 30 and 60 degrees. In some examples, additionally or alternatively, the angle 646 may be equal to an angle between 40 and 50 degrees. In one example, the angle 646 is equal to 45 degrees. As such, the plurality of arms 632 may be arranged such that a twist may be imparted onto a fuel mixture flow, wherein the twist may increase turbulence of the fuel mixture flow and decrease penetration of a fuel mixture flow flowing out of the plurality of arms 632 relative to a fuel mixture flow flowing out of the central region 634.

Turning now to FIG. 6C, it shows an additional embodiment 650 of a fuel injector nozzle passage 652 comprising an inlet 660 and an outlet 670. The inlet 660 may comprise a first shape and the outlet 670 may comprise a second shape, different than the first shape of the inlet 660. The inlet 660 may be substantially circular, however, the inlet 660 may be other shapes including one or more of triangular, square, rectangular, pentagonal, or the like, without departing from a scope of the present disclosure.

The outlet 670 may comprise a plurality of openings arranged to resemble a smiley face. The outlet 670 may comprise a plurality of openings 672 and a single opening 674. The plurality of openings 672 may comprise a first opening 672A and a second opening 672B, wherein the first and second openings may be substantially identical in one or more of size and shape. The first and second openings 672A, 672B may be the "eyes" of the smiley face and comprise a cylinder shape. The single opening 674 may be crescent shaped or other similar shape (e.g., a banana shape). The single opening 674 may represent a "mouth" of the smiley face. The single opening 674 may comprise two separate curves resembling "lips" of the "mouth" of the smiley face, wherein the two separate curves may combine at a first end point 676A and a second end point 676B. The first and second end points 676A, 676B may be arranged along a common axis 678. The common axis 678 may extend through a portion of the plurality of openings 672. In some examples, the common axis 678 may be offset to first and second injection axes 679A, 679B of the first and second openings 672A, 672B, wherein the first and second injection axes 679A, 679B are parallel to one another. Additionally or alternatively, the common axis 678 may intersect the first and second injection axes 679A, 679B. In one example, the intersection between the common axis 678 and the first and second injection axes 679A, 679B may be a perpendicular intersection. In one example, the fuel injection nozzle passage 652 comprises no other inlets or additional outlets other than the plurality of openings 672 and the single opening 674.

Turning now to FIG. 7A, it shows an example 700 of the first injector nozzle passage 232 of FIG. 2. As shown, the injector nozzle passage 232 comprises an inlet 702 and an outlet 704. The outlet 704 may be shaped similarly to outlet 430 of FIG. 4. Additionally or alternatively, the outlet 704 may be different than the outlet 430 in that the outlet 704 may comprise straight sides and angled corners while the outlet 430 comprises curved sides and intersections. The inlet 702 may be circular, however, the inlet 702 may be rectangular, similar to inlet 420 of FIG. 4, square, triangular, or the like.

The outlet 704 may be arranged directly across from the inlet 702 such that a single injection axis may pass through geometric centers of each of the inlet 702 and the outlet 702. In this way, the fuel mixture may flow directly from the inlet 702 to the outlet 704 without twisting or turning due to a misalignment of the inlet 702 and the outlet 704. However, the mismatched shapes of the outlet 704 and the inlet 702 may still impart a swirl or other turbulence generating flow pattern onto the flow mixture despite the inlet 702 and outlet 704 being aligned along the single injection axis.

Turning now to FIG. 7B, it shows an example 720 of the second injector nozzle passage 234 of FIG. 2. As shown, the injector nozzle passage 234 comprises an inlet 722 and an outlet 724. The outlet 724 may be shaped similarly to the oblong shape of outlet 330 of FIG. 3. Additionally or alternatively, the outlet 724 may be different than the outlet 330 in that the outlet 724 may comprise dimensions different than the outlet 330. The inlet 722 may be circular, however, the inlet 722 may be rectangular, similar to inlet 320 of FIG. 3, square, triangular, or the like.

The outlet 724 may be offset to the inlet 722 such that an injection axis 726 of the outlet 724 may be angled via an angle 729 relative to an injection axis 728 of the inlet 722. The angle 729 may be equal to an angle between 1 and 80 degrees. In some examples, additionally or alternatively, the angle 729 may be equal to an angle between 5 and 70 degrees. In some examples, additionally or alternatively, the angle 729 may be equal to an angle between 5 and 60 degrees. In some examples, additionally or alternatively, the angle 729 may be equal to an angle between 5 and 50 degrees. In some examples, additionally or alternatively, the angle 729 may be equal to an angle between 5 and 40 degrees. In some examples, additionally or alternatively, the angle 729 may be equal to an angle between 5 and 30 degrees. In some examples, additionally or alternatively, the angle 729 may be equal to an angle between 5 and 20 degrees. In some examples, additionally or alternatively, the angle 729 may be equal to an angle between 10 and 20 degrees. In one example, the angle 729 is exactly 15 degrees. In this way, fuel flow from the inlet 722 to the outlet 724 may be affected by the change in shape of the fuel injector nozzle passage 234 from the inlet 722 to the outlet 724 and by the misalignment between the inlet 722 and the outlet 724.

Turning now to FIG. 7C, it shows an example 740 of the third fuel injector nozzle passage 236 of FIG. 2. As shown, the injector nozzle passage 236 comprises an inlet 742 and an outlet 744. Each of the inlet 742 and the outlet 744 may be similarly shaped. In one example, each of the inlet 742 and the outlet 744 is circular. However, it will be appreciated that the inlet 742 and the outlet 744 may be other shapes without departing from a scope of the present disclosure including but not limited to triangular, square, rectangular, pentagonal, oblong, diamond, football, sombrero, and the like.

The inlet 742 and the outlet 744 may be oriented such that an injection axis 746 of the outlet 744 and an injection axis 748 of the inlet 742 are misaligned by an angle 749. The angle 749 may be equal to an angle between 1 and 60 degrees. In some examples, additionally or alternatively, the angle 749 may be equal to an angle between 1 and 50 degrees. In some examples, additionally or alternatively, the angle 749 may be equal to an angle between 1 and 40 degrees. In some examples, additionally or alternatively, the angle 749 may be equal to an angle between 1 and 30 degrees. In some examples, additionally or alternatively, the angle 749 may be equal to an angle between 1 and 20 degrees. In some examples, additionally or alternatively, the angle 749 may be equal to an angle between 1 and 10 degrees. In some examples, additionally or alternatively, the angle 749 may be equal to an angle between 3 and 8 degrees. In some examples, additionally or alternatively, the angle 749 may be equal to an angle between 3 and 6 degrees. In one example, the angle 749 is exactly 5 degrees. In this way, a fuel mixture flowing through the injector nozzle passage 236 may comprise increased turbulence relative to an aligned, linear, and uniformly shaped nozzle passage due to the misalignment of the inlet 742 and the outlet 744 along with the change in dimensions of the outlet 744 relative to the inlet 742.

Figure 8A:
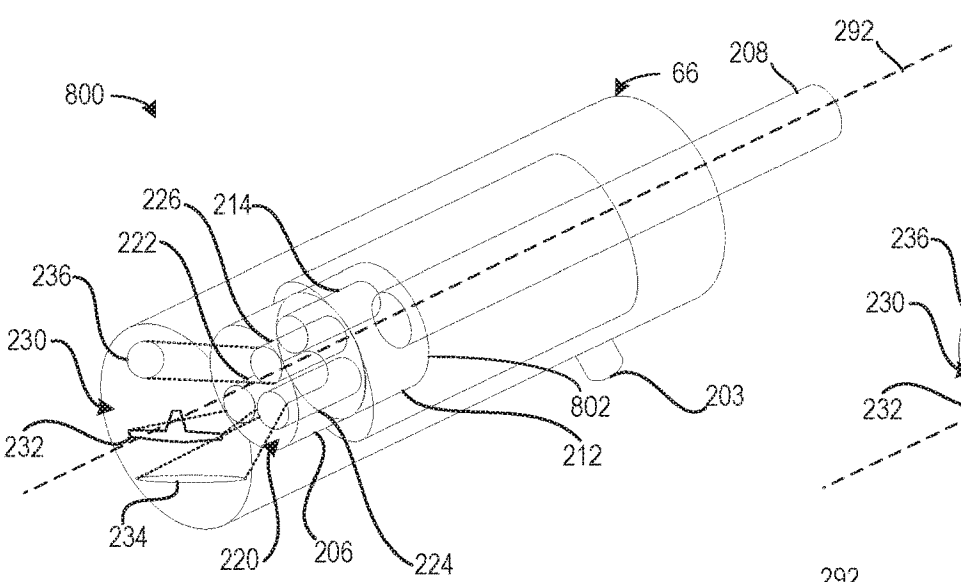
Figure 9:
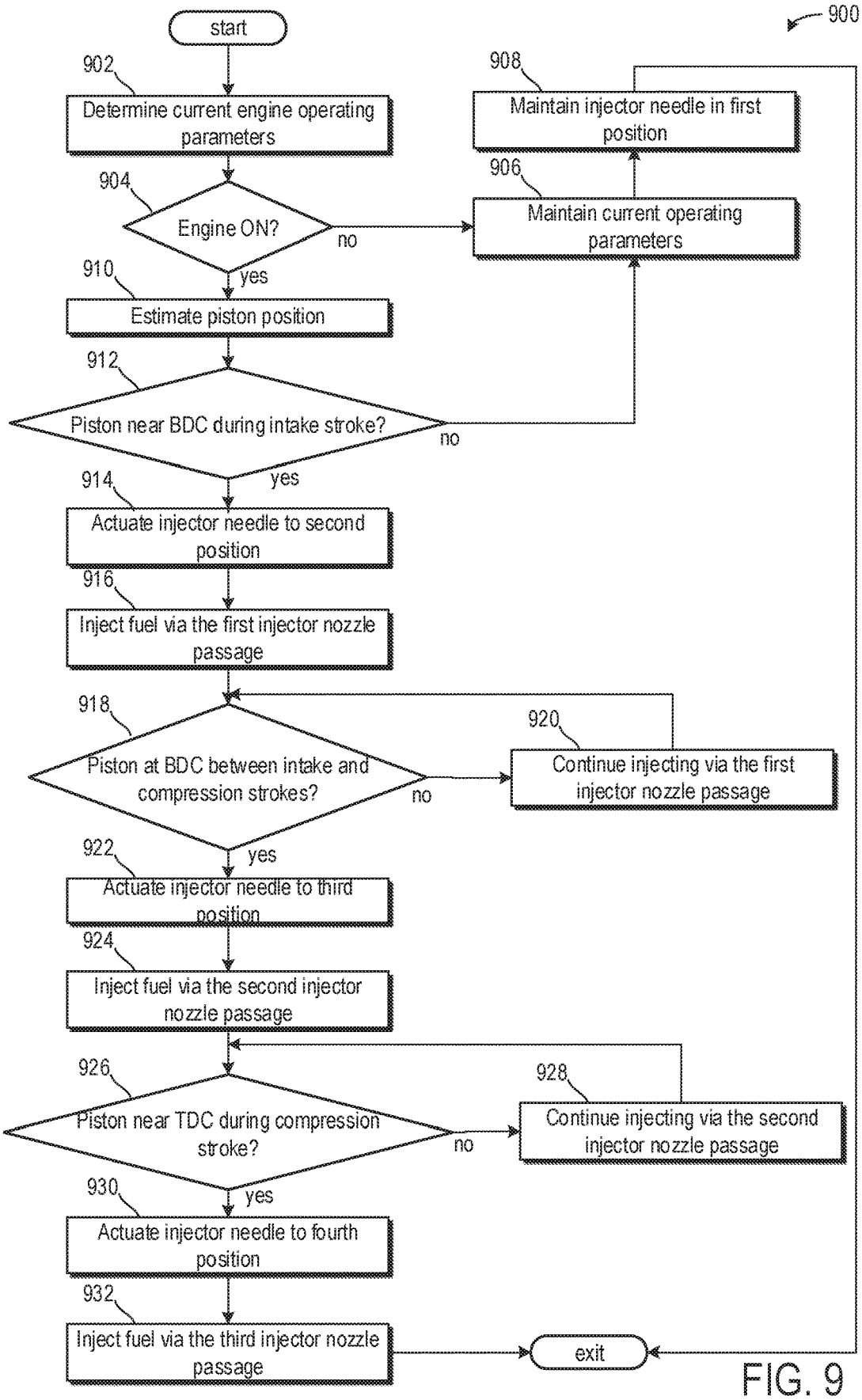
FIG. 9 illustrates a method for actuating an injector pin of the fuel injector to select between the plurality of fuel injector nozzle passages.

Turning now to FIG. 8A, it shows a first position 800 of the fuel injector 66 of FIGS. 1 and 2. The first position may correspond to an off position and/or fully closed position of the fuel injector 66, wherein the first position may not flow a fuel mixture into a combustion chamber. In this way, the fuel injector 66 may be moved to the first position in response to a fuel injection request being absent. In the first position, the injector upper tube 214 may be misaligned with each of the first, second, and third lower injector tubes 222, 224, and 226. As such, fuel in the injector upper tube 214 may remain in the injector upper tube 214 and may not enter the combustion chamber.

In one example, the injector cylindrical pin 212 and the injector upper tube 214 are rotated about the central axis 292 to the first position, which may align the injector upper tube 214 with a first quadrant of the pre-nozzle chamber 206. The first quadrant may be free of a lower tube such that the first quadrant is sealed from the injector upper tube 214. In this way, fuel in the injector upper tube 214 may not flow to the pre-nozzle chamber 206.

Turning now to FIG. 8B, it shows a second position 825 of the fuel injector 66 of FIGS. 1 and 2. The second position 825 may correspond to an open position of the fuel injector 66, wherein the second position 825 may flow a fuel mixture into the combustion chamber. More specifically, the second position 825 may comprise the injector upper tube 214 being aligned with the first lower tube 222. As such, fuel may flow from the injector upper tube 214, through the first lower tube 222, through the first injector nozzle passage 232, and into the combustion chamber. In one example, when the fuel injector is in the second position 825, fuel may not flow through the second and third lower tubes 224 and 226.

In one example, the injector cylindrical pin 212 and the injector upper tube 214 may be rotated 90 degrees counterclockwise about the central axis 292 relative to the first position 800 of FIG. 8A. The injector upper tube 214 may be positioned toward a second quadrant of the pre-nozzle chamber 206, wherein the second quadrant comprises the first lower tube 222.

Figure 8D:
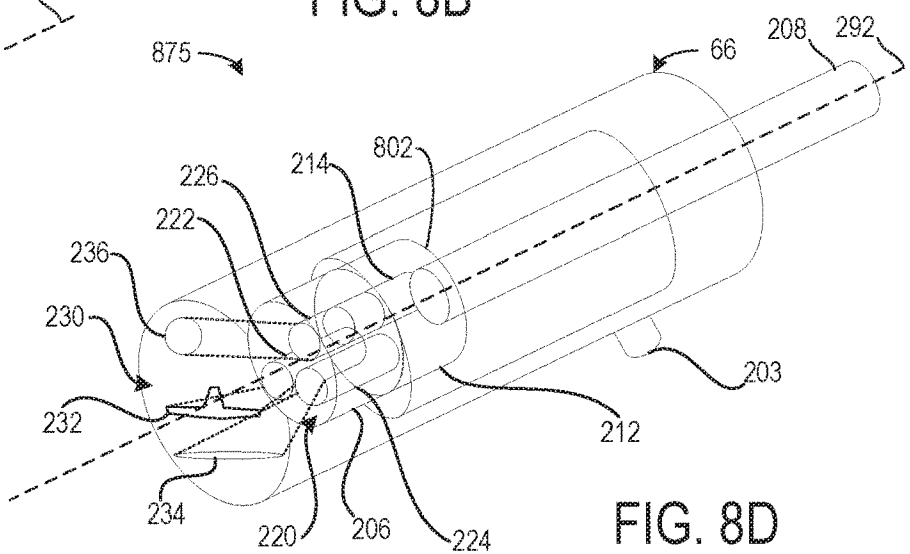
Figure 8C:
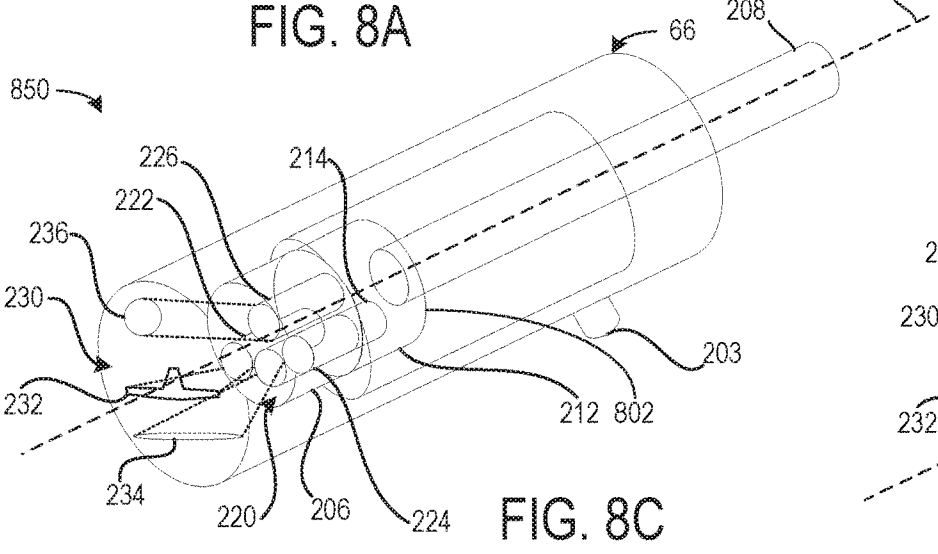

Turning now to FIG. 8C, it shows a third position 850 of the fuel injector 66 of FIGS. 1 and 2. The third position 850 may correspond to an open position of the fuel injector 66, wherein the third position 850 may flow a fuel mixture into the combustion chamber. More specifically, the third position 850 may comprise the injector upper tube 214 being aligned with the second lower tube 224. As such, fuel may flow from the injector upper tube 214, through the second lower tube 224, through the second injector nozzle passage 234, and into the combustion chamber. In one example, when the fuel injector is in the third position 850, fuel may not flow through the second and third lower tubes 224 and 226.

In one example, the injector cylindrical pin 212 and the injector upper tube 214 may be rotated 90 degrees counterclockwise about the central axis 292 relative to the second position 825 of FIG. 8B. The injector upper tube 214 may be positioned toward a third quadrant of the pre-nozzle chamber 206, wherein the third quadrant comprises the second lower tube 224.

Turning now to FIG. 8D, it shows a fourth position 875 of the fuel injector 66 of FIGS. 1 and 2. The third position 875 may correspond to an open position of the fuel injector 66, wherein the fourth position 875 may flow a fuel mixture into the combustion chamber. More specifically, the fourth position 875 may comprise the injector upper tube 214 being aligned with the third lower tube 226. As such, fuel may flow from the injector upper tube 214, through the third lower tube 226, through the third injector nozzle passage 236, and into the combustion chamber.

In one example, the injector cylindrical pin 212 and the injector upper tube 214 may be rotated 90 degrees counterclockwise about the central axis 292 relative to the third position 850 of FIG. 8C. The injector upper tube 214 may be positioned toward a fourth quadrant of the pre-nozzle chamber 206, wherein the fourth quadrant comprises the third lower tube 226.

Turning now to FIG. 9, it shows a method 900 for actuating the injector cylinder pin and the injector upper tube 214 in response to a piston position. Instructions for carrying out method 900 may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 900 begins at 902, which may include determining current engine operating parameters. Current engine operating parameters may include one or more of but are not limited boost, throttle position, engine temperature, EGR flow rate, and air/fuel ratio.

The method 900 may proceed to 904 to determine if the engine is ON. The engine may be ON if combustion is desired. Therefore, the engine is ON outside of a coasting event, where combustion is not desired and outside of an engine OFF event where a key is outside of an engine ignition or if an ignition button is not depressed.

If the engine is not ON, then the method 900 may proceed to 906 to maintain current operating parameters. The method 900 may proceed to 908 to maintain injector pin in a first position. The first position may comprise where the injector upper tube is arranged adjacent to the first quadrant of the pre-nozzle chamber, wherein the first quadrant is sealed from the injector upper tube, and thereby preventing fuel from entering the combustion chamber.

If the engine is ON, then the method 900 may proceed to 910 to estimate a piston position. The piston position may be estimated based on feedback from Hall Effect sensor 118 of FIG. 1.

The method 900 may proceed to 912, which may include determining if the piston is near BDC during an intake stroke. In one example, the piston may be near BDC if the piston is within a 20% or less of BDC, wherein the 20% may be equal to one twentieth of a total range of motion of the piston. It will be appreciated that the piston may be near BDC at other percentages less than 35% of the total range of motion of the piston.

If the piston is outside of the BDC position between the intake and compression strokes, then the method 900 may proceed to 906 as described above. If the piston is at or near BDC between the intake and compression strokes, then the method 900 may proceed to 914, which may include actuating the injector pin to a second position. Actuating the injector to the second position may comprise where the controller may make a logical determination (e.g., regarding a position of injector needle 208) based on logic rules that are a function of injection amount, injection timing, and fuel injection pattern. The controller may then generate a control signal that is sent to the injector needle 208 to actuate the fuel injector to the second position.

In one example, during a combustion cycle for a four stroke engine, the fuel injector may begin at the first position where fuel injection does not occur. Once the intake stroke is near completion or is complete and the piston is at or near BDC between the intake and compression strokes, the injector may be actuated to the second position from the first position. Actuating the injector from the first position to the second position may comprise signaling to the injector needle to rotate the injector cylindrical pin about a central axis of the injector to rotate the injector upper tube outside of the first position. The second position may be rotated 90 degrees relative to the first position thereby aligning the injector upper tube with a first injector lower tube, which may correspond with a first injector nozzle passage. The first injector nozzle passage may comprise an inlet differently shaped than an outlet.

The method 900 may proceed to 916, which may include injecting fuel via the first injector nozzle passage. In one example, the outlet of the first injector nozzle passage may comprise a sombrero or upside-down T-shape. In some examples, additionally or alternatively, the outlet may comprise a smiley face shape, a twisted plus-shape, or an oblong shape. The injection pattern of the first injector nozzle passage may be shaped to avoid valve and piston wetting. In some examples, the injection pattern of the first injector nozzle passage may be further shaped to contact or come within a threshold proximity of a spark plug.

The method 900 may proceed to 918, which may include determining if the piston is at BDC between intake and compression strokes. The piston may be at BDC if the piston is at a lower extreme end of its range of motion, wherein the piston has completed its descent for the intake stroke and is beginning its ascent for the compression stroke.

If the piston is not at BDC between the intake and the compression strokes, and therefore the piston is still on a downward motion toward BDC during the intake stroke, then the method 900 may proceed to 920 to maintain the injector in the second position and to continue injecting via the first injector nozzle passage.

If the piston is at BDC between the intake and compression strokes, then the method 900 may proceed to 922, which may include actuating the injector needle to a third position. Actuating the injector needle to the third position from the second position may comprise where the controller signals to the injector needle to rotate about the central axis of the fuel injector. The injector needle may be rotate 90 degrees relative to the second position, thereby rotating the injector upper tube to a third quadrant of the pre-nozzle chamber where the second lower tube is located. The injector upper tube and second lower tube may be aligned.

The method 900 proceeds to 924, which may include injecting fuel via the second injector nozzle passage. As such, fuel from the injector upper tube flows into the second lower tube, which may flow fuel to the second injector nozzle passage. The second injector nozzle passage may comprise an inlet and an outlet, wherein the inlet may be differently shaped than the outlet. The outlet may be oblong in shape. The oblong shape of the outlet of the second injector nozzle passage may be shaped to optimize a late intake and/or early compression stroke when the piston is at BDC. The oblong shape may provide a fuel pattern comprising a thin, planar sheet with a long penetration distance at its center and short penetration at radially outer locations to avoid cylinder wall wetting. However, it will be appreciated that the second injector nozzle passage may also be a sombrero shape, twisted-plus shape, triangle shape, star shape, smiley-face shape, or other shape in other embodiments. Additionally or alternatively, axes parallel to directions of injections of each of the inlet and outlet may be misaligned for the second injector nozzle passage. The second injector nozzle passage may inject fuel and may be the only injector nozzle passage injecting fuel.

The method 900 may proceed to 926, which may include determining if the piston is near TDC during the compression stroke. Additionally or alternatively, the method may determine if a spark-plug is about to or currently sparking to ignite the air/fuel mixture in the combustion chamber. If the piston is not near TDC of the compression stroke or if the spark plug is not currently or about to spark, then the method 900 may proceed to 928 to continue injecting via the second injector nozzle passage.

If the piston is near TDC of the compression stroke or if the spark plug is currently or about to spark, then the method 900 may proceed to 930 to actuate the injector needle to a fourth position. Actuating the injector needle to the fourth position may comprise where the controller signals to the injector needle to rotate about the central axis. The injector needle may rotate 90 degrees counterclockwise relative to the third position to purchase the fourth position, wherein the injector upper tube is adjacent a fourth quadrant of the pre-nozzle chamber. The injector upper tube may be aligned with the third lower injector tube, wherein fuel from the injector upper tube may be directed into the third lower injector tube.

The method 900 may proceed to 932, which may include injecting fuel via the third injector nozzle passage. The fourth position may include fuel from the third lower injector tube being directed to the third injector nozzle passage. The third injector nozzle passage may comprise an inlet and an outlet, wherein the inlet and the outlet may be similarly shape but differently sized. In one example, each of the inlet and the outlet are circular, wherein a diameter of the outlet is less than a diameter of the inlet. Furthermore the outlet may be misaligned with inlet with regard to their respective injection axes. The outlet may be shaped to provide a locally enriched air/fuel ratio near and/or within the vicinity of the spark plug. In some examples, a portion of the fuel spray from the third injector nozzle passage may contact the spark plug. The rich air/fuel ratio near the spark plug may improve combustion while increasing fuel economy as a remaining portion of the combustion chamber is more lean than the portion near the spark plug.

In this way, a fuel injector may comprise a plurality of nozzle passages, wherein each of the nozzle passages is shaped and oriented differently. Additionally, each nozzle passage may comprise an inlet and an outlet, wherein the inlet may differ from the outlet in one or more of size and shape. The technical effect of providing a fuel injector with the plurality of nozzle passages is to improve combustion conditions by increasing air/fuel mixing during different positions of the piston to decrease emissions and increase power output while not wetting surfaces of the combustion chamber, the piston, and valves.

An embodiment of an injector, comprising a first injector nozzle passage twisting from a first inlet to a first outlet, the first inlet shaped differently than the first outlet and a second injector nozzle passage twisting from a second inlet to a second outlet, the second inlet shaped differently than the second outlet. A first example of the injector further comprises where the first and second injector nozzle passages are fluidly coupled to a combustion chamber. A second example of the injector, optionally including the first example, further comprises where the first inlet and the second inlet are identically shaped, and where a shape of the first inlet and the second inlet is a circle, a rectangle, or a square. A third example of the injector, optionally including the first and/or second examples, further includes where the first outlet and second outlet are differently shaped, and where a shape of the first outlet and the second outlet is one of a football, a boat, a sombrero, a cross, a smiley face, a circle, and a rectangle. A fourth example of the injector, optionally including one or more of the first through third examples, further includes where the first injector nozzle passage twists, along a length of the first injector nozzle passage, as it transitions from a shape of the first inlet to a shape of the first outlet. A fifth example of the injector, optionally including one or more of the first through fourth examples, further includes where the second injector nozzle passage twists, along a length of the second injector nozzle passage, as it transitions from a shape of the second inlet to a shape of the second outlet. A sixth example of the injector, optionally including one or more of the first through fifth examples, further includes where a cross-section at a midpoint of the first injector nozzle passage equally resembles a shape of the first inlet and a shape of the first outlet. A seventh example of the injector, optionally including one or more of the first through sixth examples, further includes where a cross-section at a midpoint of the second injector nozzle passage equally resembles a shape of the second inlet and a shape of the second outlet.

An embodiment of a system comprising an engine comprising at least one cylinder and a fuel injector positioned to inject into the at least one cylinder, and where the fuel injector comprises a plurality of injector nozzle passages including a first injector nozzle passage, a second injector nozzle passage, and a third injector nozzle passage, the first injector nozzle passage comprising a first inlet differently shaped than a first outlet, the second injector nozzle passage comprising a second inlet differently shaped than a second outlet, and the third injector nozzle passage comprising a third inlet differently shaped than a third outlet, and where each of the first, second, and third outlets are shaped differently and oriented differently relative to a central axis of the fuel injector. A first example of the system further includes where the first inlet and the first outlet are aligned along an axis parallel to the central axis of the fuel injector, and where the first inlet is circle shaped and the first outlet is sombrero shaped, and where the first injector nozzle passage evenly distorts from the first inlet to the first outlet, and where a cross-section of a midpoint of the first injector nozzle passage equally resembles the first inlet and the first outlet in shape, wherein a cross-section taken between the first inlet and the midpoint more closely resembles the shape of the first inlet than the first outlet, and where a cross-section taken between the midpoint and the first outlet more closely resembles the shape of the first outlet than the first inlet. A second example of the system, optionally including the first example, further includes where the second inlet and the second outlet are misaligned relative to respective injection axes, and where an injection axis of the second inlet is parallel to the central axis of the fuel injector, and where an injection axis of the second outlet is angled relative to the central axis of the fuel injector by an angle between 5 and 30 degrees, and where the second inlet is circle shaped, and the second outlet is ellipse shaped, and where the second injector nozzle passage evenly distorts from the second inlet to the second outlet, and where a cross-section of a midpoint of the second injector nozzle passage equally resembles the second inlet and the second outlet in shape, wherein a cross-section taken between the second inlet and the midpoint more closely resembles the shape of the second inlet than the second outlet, and where a cross-section taken between the midpoint and the second outlet more closely resembles the shape of the second outlet than the second inlet. A third example of the system, optionally including the first and/or second examples, further includes where the third inlet and the third outlet are misaligned relative to respective injection axes, and where an injection axis of the third inlet is parallel to the central axis of the fuel injection, and where an injection axis of the third outlet is angled relative to the central axis of the fuel injector by an angle between 1 and 10 degrees, and where the third inlet and the third outlet are circle shaped, the third inlet comprising a diameter greater than a diameter of the third outlet, and where a cross-section of a midpoint of the third injector nozzle passage comprises a diameter equal to half of a sum of the diameters of the third inlet and the third outlet. A fourth example of the system, optionally including one or more of the first through third examples, further includes where at least one of the first injector nozzle passage, the second injector nozzle passage, or the third injector nozzle passage twists from a circle-shape to a plus-shape, and where the twist is based on an angle generated between axes of the arms of the plus-shape and axes of origination at the circle shape. A fifth example of the system, optionally including one or more of the first through fourth examples, further includes where at least one of the first injector nozzle passage, the second injector nozzle passage, or the third injector nozzle passage transitions from a circle-shape to a smiley-face shape comprising two identical cylindrical outlets and a single banana shaped outlet. A sixth example of the system, optionally including one or more of the first through fifth examples, further includes where the first injector nozzle passage, the second injector nozzle passage, and the third injector nozzle passage are arranged in different quadrants of an extreme end of the fuel injector, and where at least one quadrant of the fuel injector is sealed from the combustion chamber.

An embodiment of a method comprising selecting between a plurality of differently shaped fuel injector nozzle passages of a fuel injector based on a fuel injection demand and a position of a piston, the piston included in a cylinder that the fuel injector is positioned to inject fuel into and adjusting a position of an injector pin of the fuel injector to inject fuel from the selected fuel injector nozzle passages. A first example of the method, further includes where adjusting the injector pin of the fuel injector further comprises adjusting the injector pin to a first position in response to a fuel injection demand being absent, adjusting the injector pin to a second position in response to a fuel injection demand being present and a piston being above BDC during an intake stroke, adjusting the injector pin to a third position in response to the fuel injection demand still being present and the piston being at BDC between the intake stroke and a compression stroke, and adjusting the injector pin to a fourth position in response to the fuel injection demand still being present and the piston being adjacent TDC of the compression stroke, wherein the second position corresponds to fuel being injected through a first injector nozzle passage comprising a first outlet comprising a first shape, the third position corresponds to fuel being injected through a second injector nozzle passage comprising a second outlet comprising a second shape different than the first shape, and the fourth position corresponds to fuel being injected through a third injector nozzle passage comprising a third outlet comprising a third shape different than each of the first and second shapes. A second example of the method, optionally including the first example, further includes where each of the first, second, and third shapes are selected from one or more of a plus-shape, a smiley face, a sombrero, an upside-down T, and a football. A third example of the method, optionally including the first and/or second examples, further includes where adjusting the injector pin further includes rotating an upper tube to fluidly couple the upper tube to a plurality of lower tubes corresponding to the first, second, and third injector nozzle passages or to fluidly seal the upper tube from the lower tubes. A fourth example of the method, optionally including one or more of the first through third examples, further includes where injecting fuel through only one of the first, second, and third fuel injector nozzle passages for each of the second, third, and fourth positions, and where each of the first, second, and third outlets is differently shaped from a corresponding inlet.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An injector, comprising:

a first injector nozzle passage twisting from a first inlet to a first outlet, the first inlet shaped differently than the first outlet, where the first outlet has a first outlet shape that includes a plurality of arms, and where the twisting of the first injector nozzle passage is formed by a first profile of the plurality of arms of the first outlet shape extending from the first outlet towards the first inlet at a first angle; and a second injector nozzle passage twisting from a second inlet to a second outlet, the second inlet shaped differently than the second outlet, where the second outlet has a second outlet shape that includes a plurality of arms, and where the twisting of the second injector nozzle passage is formed by a second profile of the plurality of arms of the second outlet shape extending from the second outlet towards the second inlet at a second angle.

2. The injector of claim 1, wherein the first and second injector nozzle passages of the injector are fluidly coupled to a combustion chamber.

3. The injector of claim 1, wherein a first inlet shape at the first inlet and a second inlet shape at the second inlet are identical, and where each of the first inlet shape and the second inlet shape is a circle.

4. The injector of claim 1, wherein each of the first outlet shape and the second outlet shape is a plus-shape.

5. The injector of claim 1, wherein the first profile of the plurality of arms of the first outlet shape twists, along a length of the first injector nozzle passage, as the first profile transitions from the first outlet shape to a first inlet shape.

6. The injector of claim 1, wherein the second profile of the plurality of arms of the second outlet shape twists, along a length of the second injector nozzle passage, as the second profile transitions from the second outlet shape to a second inlet shape.

7. A system, comprising:

an engine comprising at least one cylinder; and a fuel injector positioned to inject into the at least one cylinder, and where the fuel injector comprises a plurality of injector nozzle passages including a first injector nozzle passage, a second injector nozzle passage, and a third injector nozzle passage, the first injector nozzle passage comprising a first inlet differently shaped and sized than a first outlet, the second injector nozzle passage comprising a second inlet differently shaped and sized than a second outlet, and the third injector nozzle passage comprising a third inlet differently shaped and sized than a third outlet, and where each of the first, second, and third outlets are shaped and sized differently with respect to each other, and where each of the first, second, and third outlets are oriented differently relative to a central axis of the fuel injector, wherein the first inlet and the first outlet are aligned along an axis parallel to the central axis of the fuel injector, and where the first inlet is circle shaped and the first outlet is sombrero shaped.

8. The system of claim 7, wherein the second inlet and the second outlet are misaligned relative to respective injection axes, and where an injection axis of the second inlet is parallel to the central axis of the fuel injector, and where an injection axis of the second outlet is angled relative to the central axis of the fuel injector by an angle between 5 and 30 degrees, and where the second inlet is circle shaped, and the second outlet is ellipse shaped.

9. The system of claim 7, wherein the third inlet and the third outlet are misaligned relative to respective injection axes, and where an injection axis orthogonal to a cross-section of the third inlet is parallel to the central axis of the fuel injection, and where an injection axis orthogonal to a cross-section of the third outlet is angled relative to the central axis of the fuel injector by an angle between 1 and 10 degrees, and where the third inlet and the third outlet are circle shaped, the third inlet comprising a diameter greater than a diameter of the third outlet, and where a cross-section of a midpoint of the third injector nozzle passage comprises a diameter equal to half of a sum of the diameters of the third inlet and the third outlet.

10. The system of claim 7, wherein at least one of the first injector nozzle passage, the second injector nozzle passage, and the third injector nozzle passage twists from a circle-shape to a plus-shape, and where the twist is based on an angle generated between axes of arms of the plus-shape and axes of origination at the circle-shape.

11. The system of claim 7, wherein at least one of the first injector nozzle passage, the second injector nozzle passage, and the third injector nozzle passage transitions from a circle-shape to a smiley-face shape comprising two identical cylindrical outlets and a single banana shaped outlet.

12. The system of claim 7, wherein the first injector nozzle passage, the second injector nozzle passage, and the third injector nozzle passage are arranged in different quadrants at an extreme end of an injector cylindrical pin of the fuel injector, and where at least one quadrant of the fuel injector is sealed from a combustion chamber.

13. A method, comprising:

selecting between a plurality of differently shaped fuel injector nozzle passages of a fuel injector based on a fuel injection demand and a position of a piston, the piston included in a cylinder that the fuel injector is positioned to inject fuel into, each outlet of the plurality of differently shaped fuel injector nozzle passages having a different shape and size with respect to each other;

adjusting a position of an injector pin of the fuel injector to inject fuel from a selected fuel injector nozzle passage, wherein adjusting the position of the injector pin of the fuel injector further comprises adjusting the position of the injector pin to a first position in response to the fuel injection demand being absent;

adjusting the position of the injector pin to a second position in response to the fuel injection demand being present and the piston being above BDC during an intake stroke;

adjusting the position of the injector pin to a third position in response to the fuel injection demand still being present and the piston being at BDC between the intake stroke and a compression stroke; and adjusting the position of the injector pin to a fourth position in response to the fuel injection demand still being present and a spark currently being provided, wherein the second position corresponds to fuel being injected through a first injector nozzle passage comprising a first outlet of the differently shaped and sized outlets that comprises a first shape, the third position corresponds to fuel being injected through a second injector nozzle passage comprising a second outlet of the differently shaped and sized outlets that comprises a second shape different than the first shape, and the fourth position corresponds to fuel being injected through a third injector nozzle passage comprising a third outlet of the differently shaped and sized outlets that comprises a third shape different than each of the first and second shapes.

14. The method of claim 13, wherein each of the first, second, and third shapes is selected from one or more of a plus, a smiley-face, a sombrero, an upside-down T, and a football.

15. The method of claim 13, wherein adjusting the position of the injector pin further includes rotating an upper tube to fluidly couple the upper tube to a plurality of lower tubes corresponding to the first, second, and third injector nozzle passages or to fluidly seal the upper tube from the lower tubes.

16. The method of claim 13, further comprising injecting fuel through only one of the first, second, and third fuel injector nozzle passages for each of the second, third, and fourth positions, and where each of the first, second, and third outlets is differently shaped from a corresponding inlet.

* * * * *